US006223439B1

(12) United States Patent
Wonderley

(10) Patent No.: US 6,223,439 B1
(45) Date of Patent: May 1, 2001

(54) UTILITY KNIFE WITH QUICK ACTION QUARTER-TURN CONNECTOR

(75) Inventor: Jeffrey W. Wonderley, Ft. Defiance, VA (US)

(73) Assignee: American Safety Razor, Verona, VA (US)

( * ) Notice: Subject to any disclaimer, the term of this patent is extended or adjusted under 35 U.S.C. 154(b) by 0 days.

(21) Appl. No.: 09/363,007

(22) Filed: Jul. 30, 1999

Related U.S. Application Data

(60) Provisional application No. 60/094,738, filed on Jul. 31, 1998, and provisional application No. 60/098,894, filed on Sep. 2, 1998.

(51) Int. Cl.[7] ..... B26B 5/00
(52) U.S. Cl. ..... 30/162; 30/335; 30/337
(58) Field of Search ..... 30/162, 330, 332, 30/335, 339, 125

(56) References Cited

U.S. PATENT DOCUMENTS

| | | | |
|---|---|---|---|
| 3,007,244 | 11/1961 | Austin | 30/162 |
| 3,509,627 | 5/1970 | Gilbert et al. | 30/332 |
| 3,660,895 | 5/1972 | West | 30/162 |
| 4,068,375 | 1/1978 | Rathbun et al. | 30/125 |
| 4,713,884 | 12/1987 | Dunnagan | 30/339 |
| 4,884,342 | 12/1989 | McNamara et al. | 30/162 |
| 5,022,156 | 6/1991 | Kallens et al. | 30/125 |
| 5,561,906 | 10/1996 | Desmarais | 30/339 |

*Primary Examiner*—H. Payer
(74) *Attorney, Agent, or Firm*—McDermott, Will & Emery

(57) ABSTRACT

In order to permit two halves of a hand tool to be quickly separated and then reconnected following an operation such as gaining access to, storing or exchanging a cutting blade, tool or the like, a connector is arranged to require rotation only through about 90° to achieve disconnection/connection. The connector has an engagement/locking feature which can pass through an elongate/shaped opening on one of the two halves, and then be prevented from passing back therethrough when the rotational angle of the connector is changed with respect to the opening and rotates the engaging/locking feature into engagement with an external surface surrounding the elongate/shaped opening.

15 Claims, 3 Drawing Sheets

UTILITY KNIFE WITH QUICK ACTION QUARTER-TURN CONNECTOR

CROSS-REFERENCE TO RELATED APPLICATIONS

This application claims priority from Provisional Patent Application Ser. No. 60/094,738 filed on Jul. 31, 1998 entitled UTILITY KNIFE WITH ¼ TURN KNOB and Provisional Patent Application Ser. No. 60-098,895 filed on Sep. 2, 1998, entitled UTILITY KNIFE WITH ONE-QUARTER TURN KNOB. The content of these Provisional Patent Applications is hereby incorporated by reference thereto.

BACKGROUND OF THE INVENTION

1. Field of the Invention

The present invention relates generally to a hand tool and more specifically to a hand tool such as a utility knife having a handle/body which can be quickly separated and re-connected via the use of a quick acting connector element so as to permit an instrument such as a blade, which is operatively mounted thereon, to be either stored in the handle or changed with a different/sharper one.

2. Description of the Relevant Art

In utility knives, by way of example, in order to permit the storage of a blade or allow the interchange with another which is stored within the hollow of the knife handle, it is necessary to provide some form of simple connection arrangement which permits a user to disconnect and separate the two halves of the handle or housing and then reconnect the same, both quickly and easily. In order to achieve this end, a simple screw connection or connections have been used. An example of such an arrangement is found in U.S. Pat. No. 4,884,342 issued on Dec. 5, 1989, in the name of McNamara et al. In other similar arrangements, these screws have, in order to facilitate disconnection even when a screwdriver is not available, been provided with suitably size slots into which a coin can be inserted and used in lieu thereof.

However, with this type of arrangement, the screw can be easily dropped and lost. To overcome this shortcoming, it has been proposed to avoid the use of simple screws and to use more specialized arrangements which feature screws having large diameter easy to grasp knobs or members of the nature disclosed in U.S. Pat. No. 5,561,906 issued on Oct. 8, 1996 in the name of Desmarais, and in U.S. Pat. No. 4,068,375 issued on Jan. 17, 1978 in the name of Ratherburn et al.

However, these arrangements, while representing an improvement over the use of screws which require either a screwdriver or small coin to loosen/tighten, still suffer from the drawback that they can require a plurality of turns to loosen/tighten the halves of the housing. Further these connectors can usually separate from the housings which they operatively interconnect, and accordingly also run the risk of becoming accidentally dropped and lost.

SUMMARY OF THE INVENTION

In light of the drawbacks of the nature alluded to above, it is sought, in accordance with the present invention to provide a utility knife or the like type of hand tool, which has a hollow two part housing, with a simple, quick acting, easy to use connection arrangement which requires only a quarter turn (i.e. rotation through about 90°) to lock/release the two halves of the tool.

A further feature the present invention seeks to provide is a connector which can be set in position in one of the two halves of the tool and retain itself in this half while remaining freely rotatable, thus obviating the problem of detaching from the tool housing and becoming lost.

In order to further simplify the disconnection/reconnection of the two halves, the present invention further seeks to enable a single connector of the above type, to provide the sole source of force which holds the two halves together and to arrange the two halves of the tool to appropriately align themselves with one another when the connector is rotated to induce interconnection.

In brief, the above aims of the present invention are met by an arrangement wherein, in order to permit two halves of a hand tool to be quickly separated and then reconnected following an operation such as the storage, accessing or replacement of a cutting blade, a connector is arranged to require rotation through an angle not more than 90° (i.e. a quarter turn) to achieve disconnection/connection. The connector according to the present invention, has a connection feature which can pass through an elongated/shaped opening on one of the two halves, and then be prevented from passing back therethrough when the rotational angle of the connector is changed with respect to the opening.

More specifically, a first aspect of the invention resides in a hand tool comprising: a handle having first and second halves; a rotatable connector for fastening the two halves together, the connector comprising: a head which is adapted to seat against an external surface portion of the first half; a shaft which is rigid with the head and which extends from the head via a first opening formed in the first housing, through the interior of the first and second halves; and an engagement member at the end of the shaft which is adapted to engage an outer surface portion of the second half when the engagement member assumes a first angular position with respect to the second half and to be aligned with a second opening formed in the second half when the engagement member assumes a second angular position with respect to the second half.

This aspect further features the provision of a retention feature which is formed on the head end of the shaft and which engages a wall portion of the first half in a manner which permits the head and shaft to rotate about an axis of the shaft but which restrains the rotatable connector against axial movement with respect to the first half.

The above aspect is such that the retaining feature comprises a radially extending flange which extends radially outward with respect to the shaft and which engages an inboard surface of a wall portion which surrounds an opening in the first half and through which the shaft of the bolt passes. This engagement feature comprises a portion which extends radially outward with respect to the shaft and is such that the radially extending portion of the engagement feature, exhibits a predetermined amount of flexibility and is adapted to seat in a recess which is formed in the outer surface portion of the second half after having being deflected by a raised portion formed beside the recess.

In one variation of this arrangement the radially extending flange portion which forms part of the retaining feature, is formed on a flexible prong member which extends along the side of the shaft. In addition the radially extending flange portion which forms part of the retaining feature has a barbed configuration to facilitate the passage thereof through the first opening and to resist the removal of the shaft from the first opening.

In addition to the above structure the first and second halves are arranged to have wall portions which engage one another in a manner that the first and second housings are aligned in a predetermined relationship when pressed together to form the handle. This facilitates the arrangement wherein the rotatable connector produces the sole force which holds the first and second halves together. A characteristic of the invention is that one quarter turn of the head and shaft moves the engagement/locking feature from the first angular position to the second angular position.

The first and second halves include a mounting arrangement which enable a blade to be removably mounted at one end of the handle and storage space wherein a blade can be stored. In addition the second opening, which is formed in the second half, is elongated to permit the passage of the engagement feature therethrough when in the first angular position.

A second aspect of the invention resides in a quarter turn fastener for a hand tool having first and second handle portions, comprising: a head adapted for manual manipulation and for ready manual rotation; a shaft rigid with the head which is arranged to pass through a first opening in the first handle portion and to extend out through a second elongate opening formed in the second handle; and an engagement/locking feature formed at the end of the shaft, the engagement feature being so dimensioned and shaped as to pass through the second opening when the shaft is in a first angular position and to engage the outer surface of the second handle portion when the shaft is rotated from the first angular position through a predetermined angle to a second angular position.

This aspect of the invention also includes a retaining feature formed on the head end of the shaft, the retaining feature being arranged to cooperate with an inwardly extending portion which is associated with the first opening in a manner which permits rotation but prevents axial displacement. The retaining feature is, this instance, a barbed shaped member supported at the end of a flexible member which extends along beside the shaft. In fact, the retaining feature comprises a flange having a frusto-conical portion which facilitates insertion through the first opening and an essentially flat surface which engages with the inwardly extending portion in a manner which resists movement of the shaft back out of the first opening.

BRIEF DESCRIPTION OF THE DRAWINGS

The various features and advantages of the present invention will become more clearly appreciated from the following detailed description of the preferred embodiment taken with the appended drawings in which.

DETAILED DESCRIPTION OF THE PREFERRED EMBODIMENTS

Figure 1:
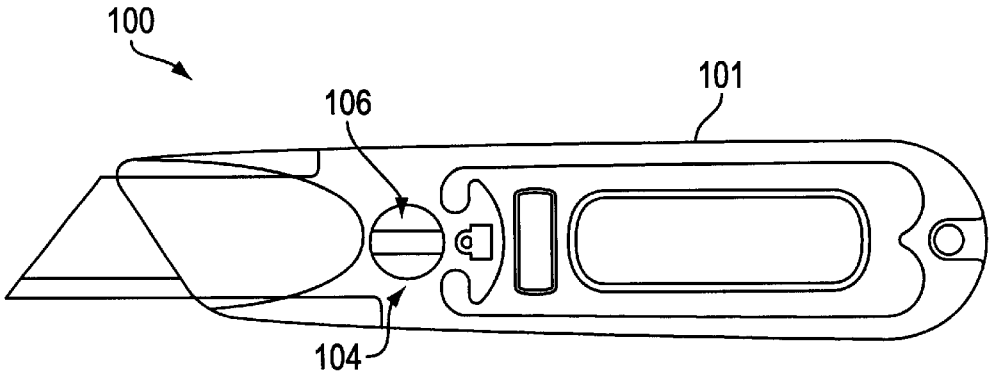
FIG. 1 is a front view of a utility knife showing the manually manipulable knob of the quarter-turn connector according to a first embodiment of the present invention.

FIGS. 1–8 show an embodiment of the present invention. In this arrangement, two housing or handle halves 101, 102, of the hand tool 100 are arranged to connected/disconnected through the use of a single quick acting connector device generally denoted by the numeral 104. As will be appreciated, the hand tool in this instance is a utility knife. However, it must be appreciated that the concept of the invention can be applied to a number of different configurations and is accordingly not necessarily limited to utility knives per se.

Details of a first embodiment of a quarter-turn connector 104 are shown in FIGS. 4–7. As illustrated, the connector consists of a unitary head 106, shaft 108 and engagement/locking feature 110. The connector 104 is made of a suitable polymer such as nylon. By way of example, the material can be Nylon 6 which can additionally contain about 20% short fiber filler to render it more resistant to high impacts. The head 106 is arranged to have a tab-like grip lug 112 which projects axially out from a circular flange portion 114, while the engagement/locking feature 110 at the other end of the shaft, in this embodiment, consists of a pair of tubular-like members 116 which each have a hollow in the form of a blind bore 118 formed therein.

The hollow construction of the engagement feature elements 116, 116 renders then sufficiently flexible as to facilitate the distortion induced as the connector 104 is induced to rotate and the engagement feature 110 is induced to ride up over a convexly raised portions 120 formed on one of the second handle half 102 (see FIG. 8) to provide a kind of click-stop detent feature. Further disclosure as to this arrangement will be given in more detail hereinlater.

In order to retain the connector 104 in position once it has been inserted through a hole formed in the first housing half 101, and prevent it from undergoing any degree of reverse axial displacement, a retaining arrangement 122, including a retention feature 124, is provided.

In accordance with a first embodiment of the invention, this retention feature 124 takes the form of a stepped frusto-conical flange which has been divided into four segments, two of which are supported on the shaft 108 proper and two which are supported on finger-like supports 126 which are defined by two slot-like cut-outs (no numerals) which are formed in the shaft 108. The flexibility of the two finger-like supports 126 enables the connector 104 to be more easily forced through the opening in the first half 101 of the housing. However, once having been inserted into position, the supports 126 flex back to their original state and cause the flat edges of the flanges 124 to engage the inboard surface of the wall in which the opening is formed.

The clearance between the flat inboard surface of the circular head flange 114 and the flat surfaces of the retention feature segments 124 is selected to be just a little greater than the thickness of the housing wall.

The retention feature 122' in accordance with the second embodiment, takes the form of a stepped frusto-conical flange 128 which can be pushed through an opening formed in a first half 101 of the housing. In this case, one or more slots 130 are formed in the side of the shaft 108 so as to remove a piece of the flange 128 in a manner which forms segments in a manner somewhat similar to the first embodiment. This renders the flange 128 a little more flexible and allows it to collapse as it is pressed through the opening in the first handle half 101, and accordingly impart a snap-action to the arrangement. As will be appreciated, once the retention feature 122' has passed through the opening, its barb-like characteristics prevent it, in the same manner as with the first embodiment, from undergoing axial displacement in a direction which is opposite that in which insertion occurred.

As discussed above, the connector 104 is disposed through an opening in a first half 101 of the housing and retained therein via the engagement between the retaining feature 122 (122') and the wall portion surrounding the opening through which the connector has been inserted. The second half of the housing, on the other hand, is formed with a keyhole-like opening 132 of the nature depicted in FIG. 8. This opening 132 is adapted to permit the engagement/locking 110 feature to pass through only when it is essentially aligned with the length of the elongate opening 132 and to be prevented from such passage after it is rotated through angle of as little as about 5–15°. That is to say, after a relatively small amount of rotation, the tubular-like projections (hereinafter tubular portions) 116 which extend out on either side of the end tip of the connector 104, begin to ride over the external surface of surrounding the opening 132, and sufficient contact is generated to prevent the second half 102 from separating from the first half 101. Upon rotation to about 90° the locking movement of the connector is completed and the two halves 101, 102 of the housing are securely locked together.

In order to prevent the unwanted rotation of the connector 104 during use, such as due to the vibrations produced by repetitive impacts or the like which can occur during the use of the hand tool, the external surface of the second half 102 which surrounds the opening is formed with a cam-like convexities (viz., the convexly raised portions 120). The central portions of each of these convexities 120 is formed with a shaped recess 134 which is adapted to receive a tubular portion 116 when it aligns with the recesses 134 and thus facilitates its seating therein. The sloped portions (120) leading up to the recesses 134 are dimensioned to induce a given amount of deflection of the tubular portions 116. The hollow nature of these structures is selected to endow sufficient flexibility and longevity as to permit repetitive locking and unlocking operations without fracture or the like degradation, and to more importantly, sufficient resilience to produce a detent action upon reaching the recesses. This, of course, holds the tubular portions 116 in place until sufficient torque is applied to the head 106 via manual manipulation to rotate them back toward the position in which the release of the locking action can be achieved.

The head 106 of the connector in this embodiment shaped to facilitate the application of torque using the thumb and forefinger of one hand. More specifically, the head 106, as described above, consists of a thick circular flange 114 which an upstanding tab-like grip lug 112. The lug or "gripper" 112 is sufficiently thick as to permit the application of sufficient torque to move the connector between locked and unlocked positions and is, due to the limited angle through which it is necessary to rotate the connector, such as represent an ergonomically easy to manipulate knob design.

Figure 2:
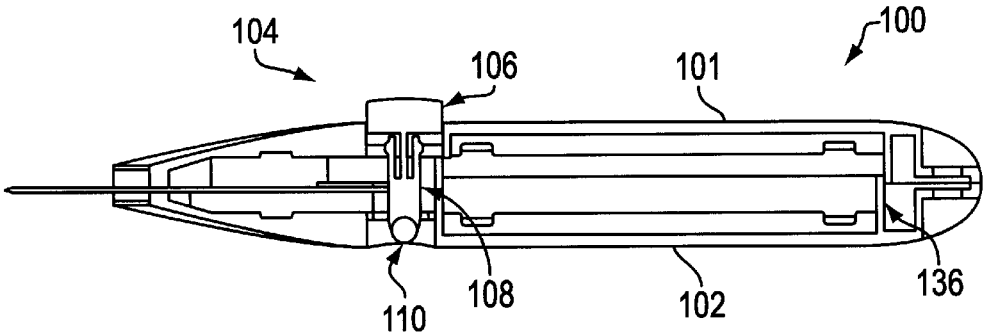
FIG. 2. is a sectional view as taken along section line of III—III of FIG. 3 showing the use of the first embodiment of a connector according to the present invention.
Figure 3:
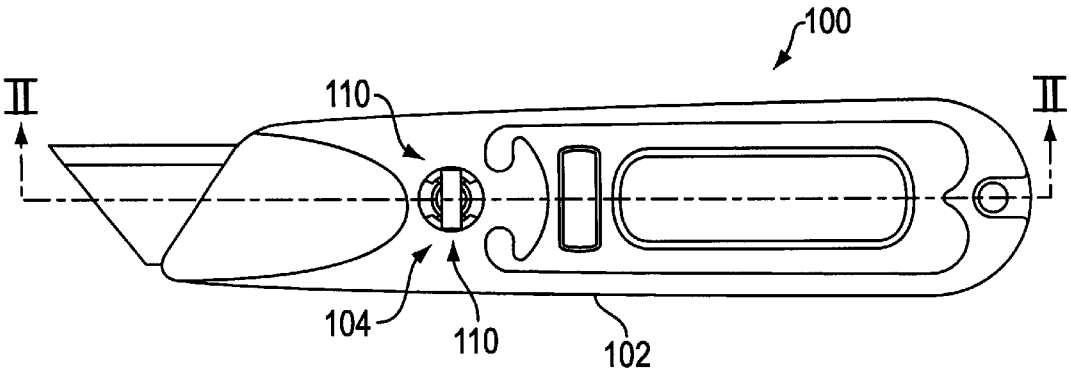
FIG. 3 is a rear side view of the utility knife which is shown in FIGS. 1 and 2, showing the connector end portion of the quarter-turn connector according to an embodiment of the present invention.
Figure 4:
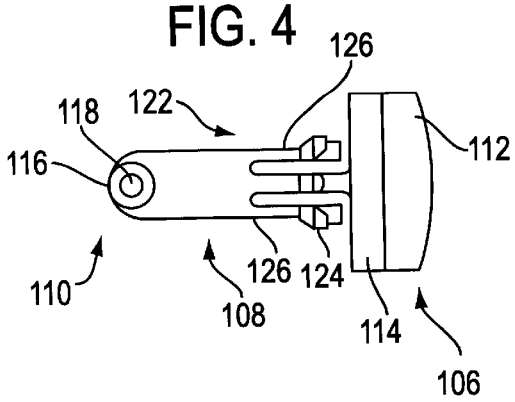
FIG. 4 side elevation of a quarter turn connector according to a first embodiment of the invention showing the provision of flexible finger elements which carry retaining features or members that facilitate the insertion and retention of the connector in an operative position in one of the handle halves.
Figure 5:
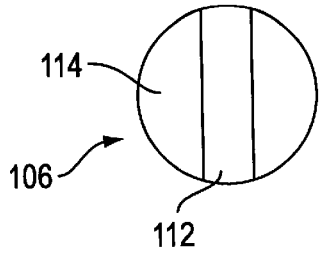
FIG. 5 is top plan view of the quarter turn connector according to the first embodiment of the invention.
Figure 8:
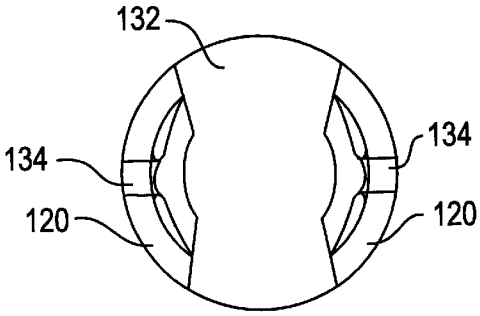
FIG. 8 is a side view showing the structure about the key hole-like opening which is formed in the second half of the tool housing and which cooperates with the engagement/locking features on the connector to produce a rotation preventing detent action.
Figure 6:
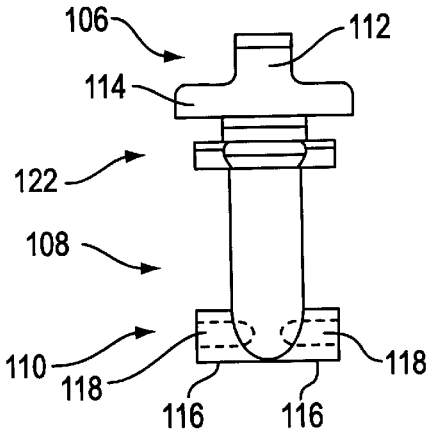
FIG. 6 is a front view of the quarter turn connector according to the first embodiment of the invention.
Figure 7:
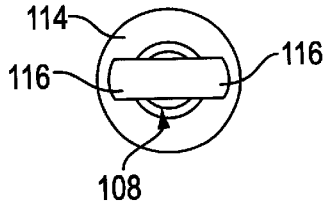
FIG. 7 is a bottom view of the quarter turn connector showing the configuration of the engagement/locking feature provided at the end of the connector according to the first embodiment.
Figure 9:
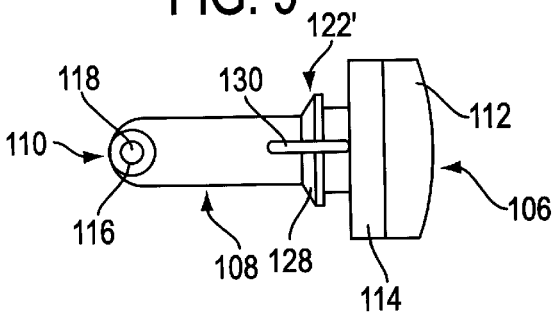
FIGS. 9 to 12 are respectively a side view, a top plan, a front view and a bottom view of a second embodiment of a connector arrangement according to the present invention.
Figure 10:
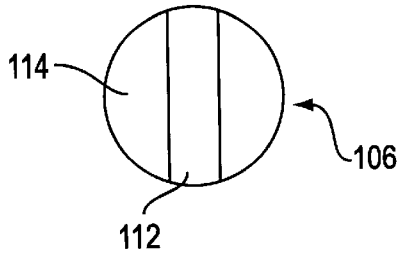
Figure 11:
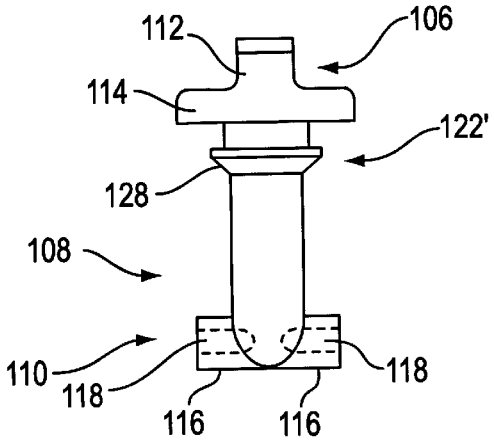
Figure 12:
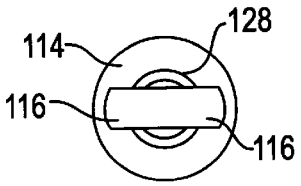

The two halves 101, 102 of the hand tool 100 are provided with at least one set of ribs, projections or features generally denoted by the numeral 136 in FIG. 2, which cause the two halves to align with one another they are pressed together so that the connecting force which is supplied by the connector according to the invention, is sufficient to hold the two bodies together in the requisite configuration. In the illustrated embodiment, this arrangement is found at the rear end of the housing and in a position which is distal from the connector so as to provide an adequate amount of half alignment. A support feature or features are provided at the front of the housing to support and orient a blade or the like type of instrument. As this type of arrangement is well within the purview of the person skilled in the art of tool design of the nature to which the present invention is directed, no further description of this or the alignment structure will be given for brevity.

It should be noted, however, that the invention is not necessarily limited to this type of knob/head arrangement and various modifications can be envisaged without departing from the scope of the invention. Similarly, the retaining structures while being effective and designed for longevity are not limited to the illustrated arrangements and any suitable form of retention arrangement can be envisaged without departing from the spirit of the invention. The scope of the invention is limited only by the appended claims.

What is claimed is:

1. A hand tool comprising:

a handle having first and second halves;

a rotatable connector for fastening the two halves together, said connector comprising:

a head that is adapted to seat against an external surface portion of the first half;

a shaft that is rigid with the head and extends from the head via a first opening formed in the first half, through the interior of the first and second halves;

an engagement/locking feature at the end of the shaft that is adapted to engage an outer surface portion of the second half when the engagement/locking feature assumes a first angular position with respect to the second half, and to be aligned with a second opening formed in the second half when the engagement/locking feature assumes a second angular position with respect to the second half; and a retention feature that is formed on the head end of the shaft and engages a wall portion of the first half in a manner that permits the head and the shaft to rotate about an axis of the shaft, but restrains the rotatable connector against axial movement with respect to the first half; wherein the retention feature is capable of being pressed through the first opening formed in the first half.

2. A hand tool as set forth in claim 1, wherein the retention feature comprises a radially extending flange which extends radially outward with respect to the shaft and which engages an inboard surface of a wall portion which surrounds an opening in the first half and through which the shaft of the connector passes.

3. A hand tool as set forth in claim 2, wherein the radially extending flange that forms part of the retention feature, is formed on a flexible prong that extends along the side of the shaft.

4. A hand tool as set forth in claim 2, wherein the radially extending flange that forms part of the retention feature has a barbed configuration to facilitate the passage thereof through the first opening and to resist the removal of the shaft from the first opening.

5. A hand tool as set forth in claim 1, wherein the engagement feature comprises a portion which extends radially outward with respect to the shaft.

6. A hand tool as set forth in claim 5, wherein the radially extending portion of the engagement feature, exhibits a predetermined amount of flexibility and is adapted to seat in a recess which is formed in the outer surface portion of the second half after having being deflected by a raised portion formed beside the recess.

7. A hand tool as set forth in claim 1, wherein the first and second halves are arranged to have wall portions which engage one another in a manner that the first and second halves are aligned in a predetermined relationship when pressed together to form the handle.

8. A hand tool as set forth in claim 1, wherein the rotatable connector produces the sole force which holds the first and second halves together.

9. A hand tool as set forth in claim 1, wherein one quarter turn of the head and shaft moves the engagement/locking feature from the first angular position to the second angular position.

10. A hand tool as set forth in claim 1, wherein said first and second halves include a mounting arrangement which enable a blade to be removably mounted at one end of the handle and storage space wherein a blade can be stored.

11. A hand tool as set forth in claim 1, wherein the second opening, which is formed in the second half, is elongated to permit the passage of the engagement feature therethrough when in the first angular position.

12. A quarter turn fastener for a hand tool having first and second handle portions, comprising:

a head adapted for manual manipulation and for ready manual rotation;

a shaft rigid with the head which is arranged to pass through a first opening in the first handle portion and to extend out through a second elongate opening formed in the second handle portion;

an engagement/locking feature formed at the end of the shaft, said engagement feature being so dimensioned and shaped as to pass through the second opening when the shaft is in a first angular position and to engage the outer surface of the second handle portion when the shaft is rotated from the first angular position through a predetermined angle to a second angular position; and a retention feature that is formed on the head end of the shaft and engages a wall portion of the first handle-portion in a manner that permits the head and the shaft to rotate about an axis of the shaft, but restrains the rotatable connector against axial movement with respect to the first handle-portion wherein the retention feature is capable of being pressed through the first opening formed in the first handle portion.

13. A fastener as set froth in claim 12, wherein retaining feature feature is arranged to cooperate with an inwardly extending portion which is associated with the first opening in a manner which permits rotation but prevents axial displacement.

14. A fastener as set forth in claim 13, wherein the retention feature is a barbed shaped member supported at the end of a flexible member which extends along beside the shaft.

15. A fastener as set forth in claim 13, wherein the retention feature comprises a flange having a frusto-conical portion which facilitates insertion through the first opening and an essentially flat surface which engages with the inwardly extending portion in a manner which resists movement of the shaft back out of the first opening.

* * * * *